US009285706B2

(12) United States Patent
Homma et al.

(10) Patent No.: US 9,285,706 B2
(45) Date of Patent: Mar. 15, 2016

(54) TONER CARTRIDGE WITH MEMORY FOR IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventors: Toru Homma, Yokohama Kanagawa (JP); Hiroshi Hashidume, Hino Tokyo (JP); Hisanobu Ajima, Yokohama Kanagawa (JP); Nobuo Tohata, Sunto Shizuoka (JP); Takahiro Nakajima, Kawasaki Kanagawa (JP); Takumi Hatano, Yokohama Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/729,679

(22) Filed: Jun. 3, 2015

(65) Prior Publication Data

US 2015/0309441 A1 Oct. 29, 2015

Related U.S. Application Data

(60) Continuation of application No. 14/320,260, filed on Jun. 30, 2014, which is a continuation of application No. 14/016,508, filed on Sep. 3, 2013, now Pat. No. 8,805,211, which is a division of application No.

(Continued)

(51) Int. Cl.
*G03G 15/08* (2006.01)

(52) U.S. Cl.
CPC ..... *G03G 15/0863* (2013.01)

(58) Field of Classification Search
CPC ..... G03G 15/086
See application file for complete search history.

(56) References Cited

U.S. PATENT DOCUMENTS

| | | | |
|---|---|---|---|
| 6,473,572 | B1 | 10/2002 | Uchiyama |
| 6,808,255 | B1 | 10/2004 | Haines et al. |
| 6,817,693 | B2 | 11/2004 | Phillips et al. |
| 6,970,661 | B2 | 11/2005 | Shoji |
| 7,218,866 | B2 | 5/2007 | Hayashi et al. |
| 8,331,807 | B2 | 12/2012 | Homma |
| 8,554,091 | B2 | 10/2013 | Homma et al. |

(Continued)

FOREIGN PATENT DOCUMENTS

| | | |
|---|---|---|
| JP | H06-113113 | 4/1994 |
| JP | H06-149051 | 5/1994 |

(Continued)

OTHER PUBLICATIONS

Japanese Office Action dated Aug. 28, 2012, filed in Japanese application No. 2008-275620, 12 pages (with translation).*

(Continued)

*Primary Examiner* — G. M. Hyder
(74) *Attorney, Agent, or Firm* — Patterson & Sheridan, LLP

(57) ABSTRACT

An image forming apparatus mounted with a toner cartridge having a memory unit includes a toner cartridge which stores a plurality of control data depending on toner in the memory unit, an acquisition unit which selects one of the plurality of control data in the memory unit and acquires image formation-related information and a setting unit which sets image formation parameters on the basis of the image formation-related information.

12 Claims, 10 Drawing Sheets

| | Bias voltage of charger |
|---|---|
| Temperature 1 | C1 |
| Temperature 2 | C2 |
| Temperature 3 | C3 |
| ⋮ | ⋮ |

| | Bias voltage of charger |
|---|---|
| Humidity 1 | D1 |
| Humidity 2 | D2 |
| Humidity 3 | D3 |
| ⋮ | ⋮ |

| | Bias voltage of charger |
|---|---|
| Life time 1 | E1 |
| Life time 2 | E2 |
| Life time 3 | E3 |
| ⋮ | ⋮ |

| Number of printed sheets | Bias voltage of charger |
|---|---|
| 1~a sheets | F1 |
| a+1~b sheets | F2 |
| b+1~c sheets | F3 |
| ⋮ | ⋮ |

Related U.S. Application Data

13/683,705, filed on Nov. 21, 2012, now Pat. No. 8,554,091, which is a continuation of application No. 13/310,631, filed on Dec. 2, 2011, now Pat. No. 8,331, 807, which is a continuation of application No. 12/257, 268, filed on Oct. 23, 2008, now abandoned.

(60) Provisional application No. 60/983,518, filed on Oct. 29, 2007, provisional application No. 61/076,988, filed on Jun. 30, 2008, provisional application No. 61/086,767, filed on Aug. 6, 2008.

(56) References Cited

U.S. PATENT DOCUMENTS

| | | | |
|---|---|---|---|
| 2004/0253006 | A1 | 12/2004 | Hayashi et al. |
| 2005/0047805 | A1 | 3/2005 | Okubo |
| 2006/0109289 | A1 | 5/2006 | Iwamoto et al. |
| 2006/0168437 | A1 | 7/2006 | Eun |
| 2006/0290951 | A1 | 12/2006 | Yamasaki et al. |
| 2008/0166138 | A1 | 7/2008 | Hanano et al. |
| 2008/0298819 | A1 | 12/2008 | Ueda |
| 2011/0274451 | A1 | 11/2011 | Kawaguchi |
| 2012/0002987 | A1 | 1/2012 | Odani |

FOREIGN PATENT DOCUMENTS

| | | |
|---|---|---|
| JP | 2003-241491 | 8/2003 |
| JP | 2005-338560 | 12/2005 |
| JP | 2007-225983 | 9/2007 |

OTHER PUBLICATIONS

Japanese Office Action dated Apr. 17, 2012, filed in Japanese application No. 2008-275620, 10 pages (with English translation).

* cited by examiner

| Toner characteristic value (toner resistance) | Control table (table recorded in recording medium) |
|---|---|
| Characteristic value A less than 8 (Ωcm*10^10) | Table ① |
| Characteristic value B 8.0 or more and less than 14.0 (Ωcm*10^10) | Table ② |
| Characteristic value C 14.0 or more (Ωcm*10^10) | Table ③ |

FIG. 5

| | Bias voltage of charger |
|---|---|
| Temperature 1 | C1 |
| Temperature 2 | C2 |
| Temperature 3 | C3 |
| ⋮ | ⋮ |

| | Bias voltage of charger |
|---|---|
| Humidity 1 | D1 |
| Humidity 2 | D2 |
| Humidity 3 | D3 |
| ⋮ | ⋮ |

| | Bias voltage of charger |
|---|---|
| Life time 1 | E1 |
| Life time 2 | E2 |
| Life time 3 | E3 |
| ⋮ | ⋮ |

| Number of printed sheets | Bias voltage of charger |
|---|---|
| 1~a sheets | F1 |
| a+1~b sheets | F2 |
| b+1~c sheets | F3 |
| ⋮ | ⋮ |

FIG. 6

| | Toner resistance | Control table | | Image concentration | Foggy rate (%) | Combinated determination |
|---|---|---|---|---|---|---|
| | (Ωcm*10^10) | MFP body | Recording medium | (LL environment) | (HH environment) | |
| Com. ex. 1 | 6 | ○ | – | 1.43 | 2.8 | × |
| Com. ex. 2 | 11 | ○ | – | 1.40 | 1.3 | × |
| Com. ex. 3 | 16 | ○ | – | 1.10 | 1.1 | × |
| Ex. 1 | 5.5 | – | Table ① | 1.42 | 1.6 | ○ |
| Ex. 2 | 10 | – | Table ② | 1.41 | 1.1 | ○ |
| Ex. 3 | 17 | – | Table ③ | 1.38 | 0.8 | ○ |

* Image concentration at 300k sheets: 1.30 or more and foggy rate less than 2.0% are determined as successful.

FIG. 7

TONER CARTRIDGE WITH MEMORY FOR IMAGE FORMING APPARATUS

CROSS-REFERENCE TO RELATED APPLICATION

This application is a continuation of U.S. patent application Ser. No. 14/320,260, filed Jun. 30, 2014 which is a continuation of U.S. patent application Ser. No. 14/016,508, filed Sep. 3, 2013, which issued as U.S. Pat. No. 8,805,211 on Aug. 12, 2014, which is a divisional of U.S. patent application Ser. No. 13/683,705, filed Nov. 21, 2012, which issued as U.S. Pat. No. 8,554,091 on Oct. 8, 2013; which is a continuation of U.S. patent application Ser. No. 13/310,631, filed Dec. 2, 2011, which issued as U.S. Pat. No. 8,331,807 on Dec. 11, 2012; which is a continuation of U.S. patent application Ser. No. 12/257,268, filed Oct. 23, 2008; which claims the benefit of U.S. Provisional Application No. 60/983,518, filed Oct. 29, 2007; U.S. Provisional Application No. 61/076,988, filed Jun. 30, 2008; and U.S. Provisional Application No. 61/086,767, filed Aug. 6, 2008; the entire contents of each of which are incorporated herein by reference.

TECHNICAL FIELD

The present invention relates to an image control technique depending on toner filled in a toner cartridge.

BACKGROUND

In the past, as described in Japanese Unexamined Patent Application Publication No. H6-149051, a method of correcting image formation conditions in consideration of characteristic data of toner stored in advance in an IC chip disposed in a toner cartridge is known.

In order to improve the color reproducibility of a color image, an image forming apparatus forms a specific solid image on a photoconductive member and reads the toner concentration thereof by use of a sensor. When the toner concentration is low or the toner concentration is high, the non-uniformity of amounts of attached color toner is adjusted by adjusting development contrast to be the proper toner concentration. Since the amounts of attached color toner can be obtained uniformly by adjusting the development contrast, it is possible to stabilize the color reproducibility of the color image in comparison with the non-adjustment of the development contrast.

However, in the configuration described in the above-mentioned patent publication, the variation in physical property of the toner due to environments is not considered and thus it cannot be said that the image formation condition is properly corrected.

When the amounts of attached toner become uniform but the toner cartridge is replaced with a toner cartridge filled with toner different color tones, the amounts of attached toner can be made to be uniform, but the color reproducibility of a color image varies from that before replacing the toner.

Accordingly, the invention provides an image forming apparatus that can properly make image control depending on a toner cartridge.

SUMMARY

According to an aspect of the invention, there is provided an image forming apparatus mounted with a toner cartridge having a memory unit, including: a toner cartridge which stores a plurality of control data depending on toner in the memory unit; an acquisition unit which selects one of the plurality of control data in the memory unit and acquires image formation-related information; and a setting unit which sets image formation parameters on the basis of the image formation-related information.

DESCRIPTION OF THE DRAWINGS

FIG. 5 is a diagram illustrating a control table used for the setting of the image forming apparatus according to the first embodiment;

FIG. 6 is a diagram illustrating the image formation parameters in the image forming apparatus according to the first embodiment;

FIG. 7 is a diagram illustrating the comparison result of a case where the image formation parameters are set and a case where the image formation parameters are not set in the image forming apparatus according to the first embodiment;

DETAILED DESCRIPTION

Embodiments will be described below with reference to the accompanying drawings.

Figure 1:
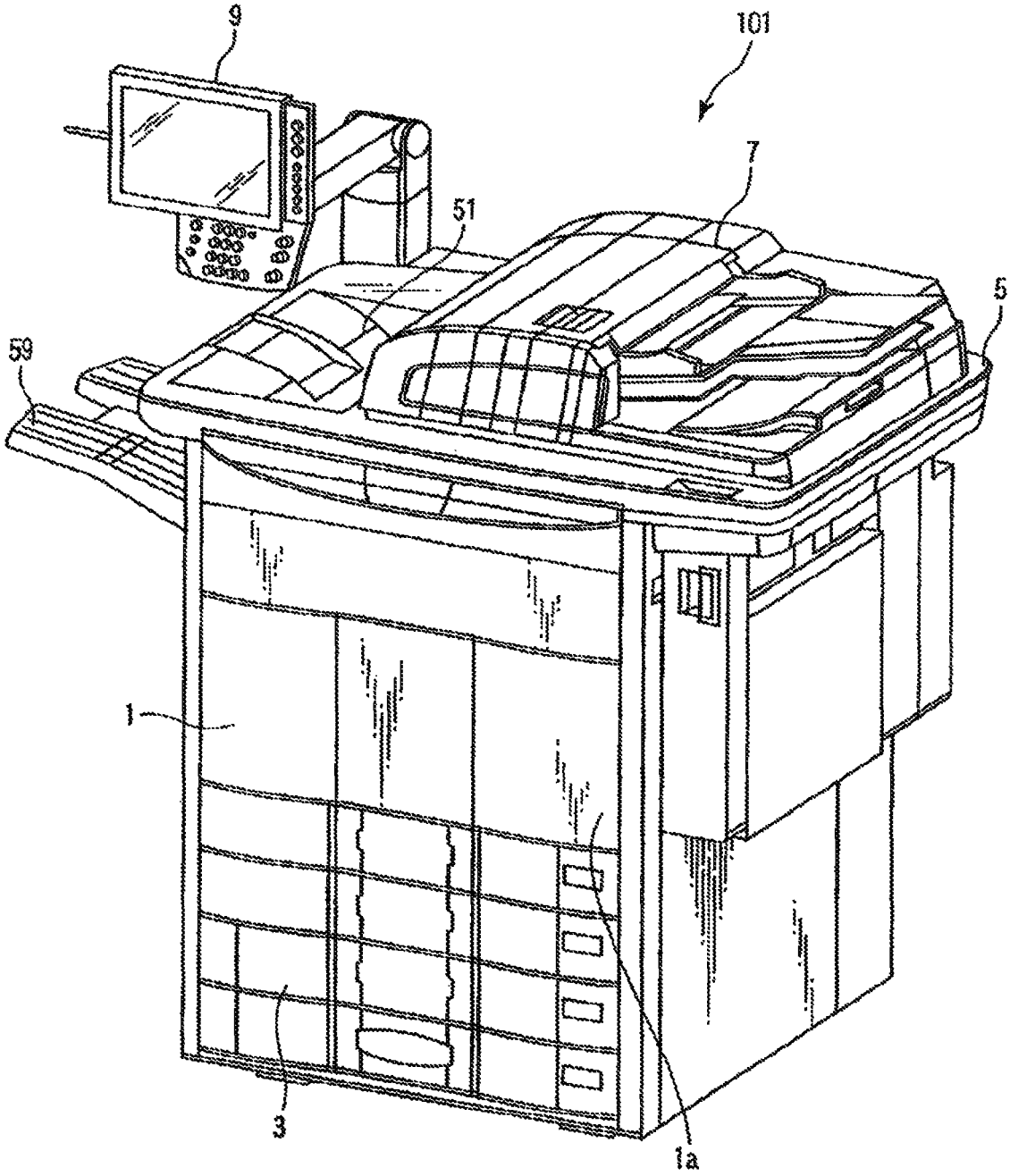
FIG. 1 is a diagram schematically illustrating an appearance of an image forming apparatus which is mounted with a toner cartridge according to a first embodiment.

FIG. 1 is a perspective view illustrating an appearance of an image forming apparatus 101 according to an embodiment. The image forming apparatus 101 is a four-tandem type color copier. The image forming apparatus 101 includes an image forming unit 1 outputting image information as an output image called a hard copy or a printout, a sheet feeding unit 3 feeding various sizes of sheets (output mediums) used for the image output to the image forming unit 1, and a scanner 5 scanning the image information, which is formed as an image by the image forming unit 1, as image data from an object (hereinafter, referred to as document) holding the image information. When the document has a sheet shape, an auto document feeder 7 discharging a document, which the image information is read by the scanner 5 from, from a reading position to a discharge position and guiding a next document to the reading position is disposed above the image forming unit 1. A command input unit commanding the image forming unit 1 to start forming an image or commanding the scanner 5 to start reading the image information of the document, that is, a display unit 9 which is a control panel, is disposed in the image forming apparatus 101.

Figure 2:
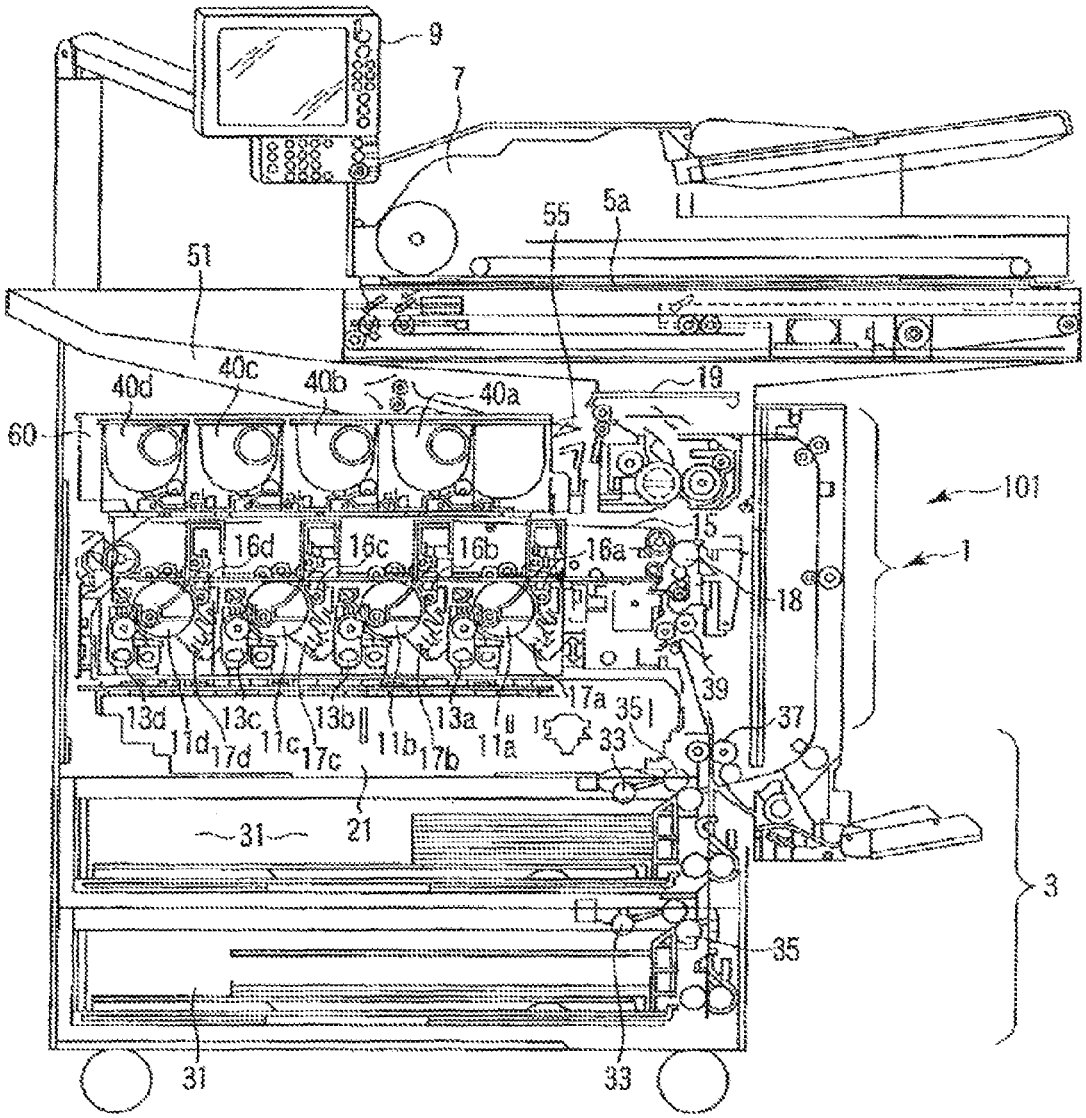
FIG. 2 is a diagram schematically illustrating an inner structure of the image forming apparatus according to the first embodiment as viewed from the front side.

FIG. 2 is a diagram schematically illustrating an inner structure of the image forming unit 1 as viewed from the front side. Toner cartridges 40*a*, 40*b*, 40*c*, and 40*d* are disposed in the upper portion of the image forming unit 1. The toner cartridges 40*a*, 40*b*, 40*c*, and 40*d* can be mounted on and demounted from a cartridge holding mechanism 60 disposed in the front side of the image forming unit 1. The toner cartridges 40*a*, 40*b*, 40*c*, and 40*d* supply toner of yellow, magenta, cyan, and black.

The image forming unit 1 includes first to fourth photoconductive drums 11*a* to 11*d* holding latent images, developing devices 13*a* to 13*d* developing the latent images formed on the photoconductive drums 11*a* to 11*d*, a transfer belt 15 holding the developer images developed on the photoconductive drums 11*a* to 11*d* in a stacked state, cleaners 16*a* to 16*d* removing the toner remaining on the photoconductive drums 11*a* to 11*d* from the photoconductive drums 11*a* to 11*d*, respectively, and chargers 17*a* to 17*d* charging the photoconductive drums 11*a* to 11*d*.

The image forming unit 1 includes a transfer device 18 transferring the developer images stacked on the transfer belt 15 to a sheet-like output medium such as a normal sheet not subjected to any particular process or an OHP sheet which is a transparent resin sheet, a fixing device 19 fixing the developer images transferred to the output medium onto the output medium, and an exposure device 21 forming the latent images on the photoconductive drums 11*a* to 11*d*.

The first to fourth photoconductive drums 11*a* to 11*d* hold electrostatic latent images (latent images) of colors to be visualized (developed) by the developing devices 13*a* to 13*d* containing color toner of Y (yellow), M (magenta), C (Cyan), and Bk (black), and the arrangement order thereof is defined as a predetermined order depending on the image forming process or the toner (developer) characteristic. The transfer belt 15 holds the color developer images formed by the first to fourth photoconductive drums 11*a* to 11*d* and the corresponding developing devices 13*a* to 13*d* in the order of forming the developer images.

The sheet feeding unit 3 feeds the output medium to the transfer device 18 at a predetermined time when the transfer device 18 transfers the developer images.

Cassettes set in plural cassettes slots 31 receive various sizes of output mediums. A pickup roller 33 picks up the output medium with the image forming operation. The size of the output medium corresponds to the size of the developer images formed by the image forming unit 1. A separation mechanism 35 prevents two or more output mediums from being picked up from the cassettes by the pickup roller 33. Plural transport rollers 37 transport the output medium, which is restricted to one sheet by the separation mechanism 35, to an aligning roller 39. The aligning roller 39 sends the output medium to a transfer position where the transfer device 18 and the transfer belt 15 come in contact with each other, at the timing when the transfer device 18 transfers the developer images from the transfer belt 15. The numbers of the cassette slots 31, the pickup rollers 33, and the separation mechanisms 35 may be two or more as needed, and the cassettes can be mounted on different slots.

The output image of which the image information is fixed onto the output medium by the fixing device 19 is discharged to a sheet discharge tray 51 disposed aside the scanner 5 and above the image forming unit 1. The image forming apparatus 101 includes a side sheet discharge tray 59 on a side surface of the image forming unit 1. The output medium discharged from the fixing device 19 is guided to the side sheet discharge tray 59 through a relay transport unit 71 connected to a switching unit 55.

Figure 3:
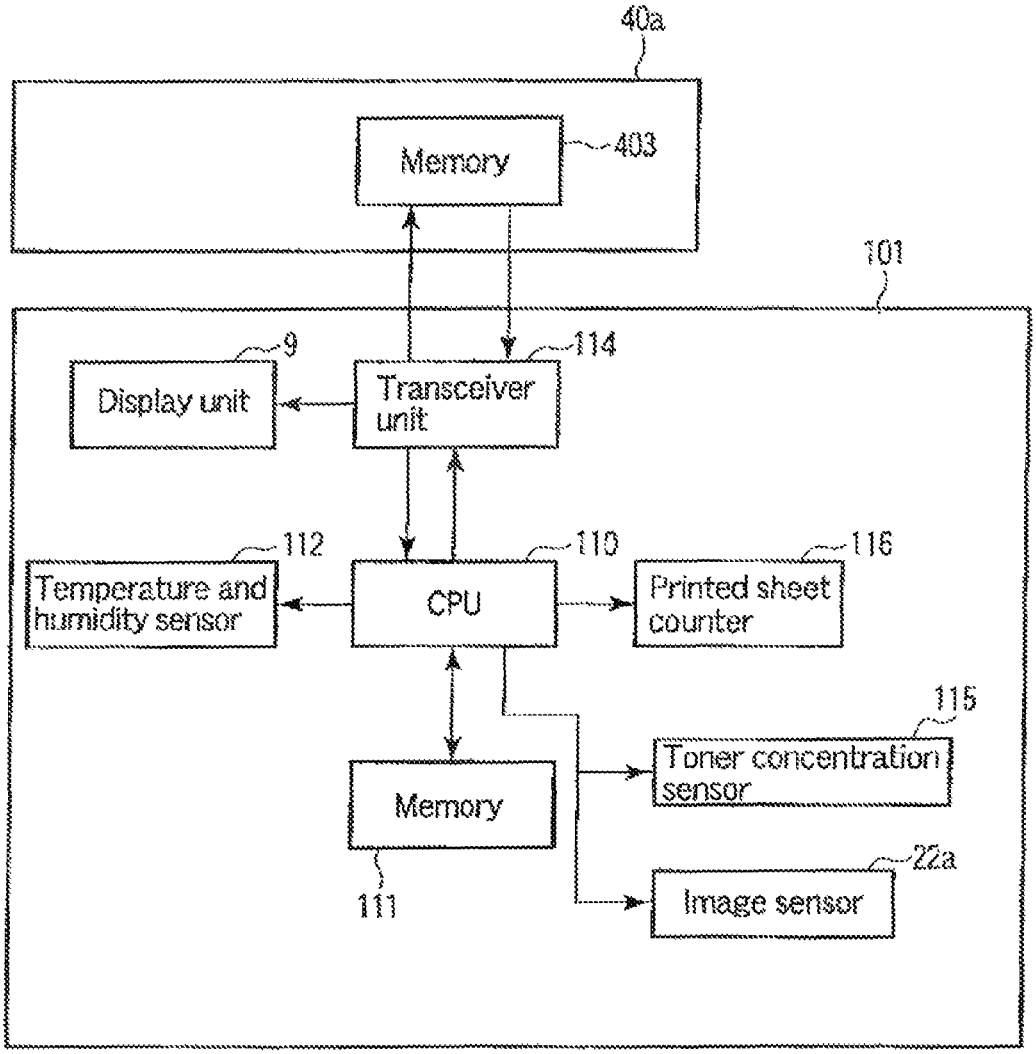
FIG. 3 is a block diagram illustrating operations of the image forming apparatus and the toner cartridge according to the first embodiment.

FIG. 3 is a block diagram illustrating operations of the toner cartridge 40*a* and the image forming apparatus 101. The toner cartridge 40*a* is described but the same is true of the toner cartridges 40*b*, 40*c*, and 40*d*.

First, an example of a procedure of setting an image formation parameter for controlling process conditions when the toner cartridge 40*a* is mounted on the image forming apparatus 101.

Here, the process condition control means the operation control of various devices necessary for actually performing a printing operation and the like. Specifically, one thereof is the control of a bias voltage value applied to the charger 17*a* for charging the photoconductive drum. The process condition control may be the operation control of the developing device 13*a*, the cleaner 16*a*, and the fixing device 19, as well as the charger 17*a*. The image formation parameter means set values for the operations of the photoconductive drum 11*a*, the developing device 13*a*, the cleaner 16*a*, the charger 17*a*, and the fixing device 19 performing the printing operation.

The toner cartridge 40*a* includes a memory 403. The memory 403 stores inquiry data and plural control tables to be described later. The memory 403 employs, for example, a general-purpose IC chip.

The control tables include plural tables storing charging voltage values of the charger 17*a* for the printing operation and the like depending on the physical properties of the toner contained in the cartridge. Instead of the charging voltage values of the charger 17*a*, set values such as a developing bias value of the developing device 13*a*, a toner concentration (or the intensity of laser beam), a peeling output voltage value of the cleaner 16*a*, a controlled voltage value of the fixing device 19, and a value relating to the operation of the photoconductive drum 11*a* may be defined. The physical properties of the toner include an amount of charged electricity of the toner, a resistance value, a manufacturing lot, and a particle diameter, and plural control tables depending on the characteristics are prepared in this embodiment.

The image forming apparatus 101 includes a CPU 110, a memory 111, a temperature and humidity sensor 112, a transceiver unit 114, and the display unit 9.

The CPU 110 controls the units of the image forming apparatus 101. The memory 111 stores a variety of information. The temperature and humidity sensor 112 is disposed at a predetermined position in the image forming apparatus 101 and serves to measure the temperature and humidity of the image forming apparatus 101.

The transceiver unit 114 reads and rewrites information recorded in the memory 403 of the toner cartridge 40*a*. The transceiver unit 114 may communicate with the memory 403 by wired or wireless. The display unit 9 displays a variety of information in response to the request of the CPU 110. A toner concentration sensor 115 is disposed in the vicinity of the developing devices 13*a* to 13*d*. The toner concentration sensor 115 senses the toner concentration of the toner contained in the developing device 13*a*. The same is true of the developing devices 13*b* to 13*d*.

Figure 4:
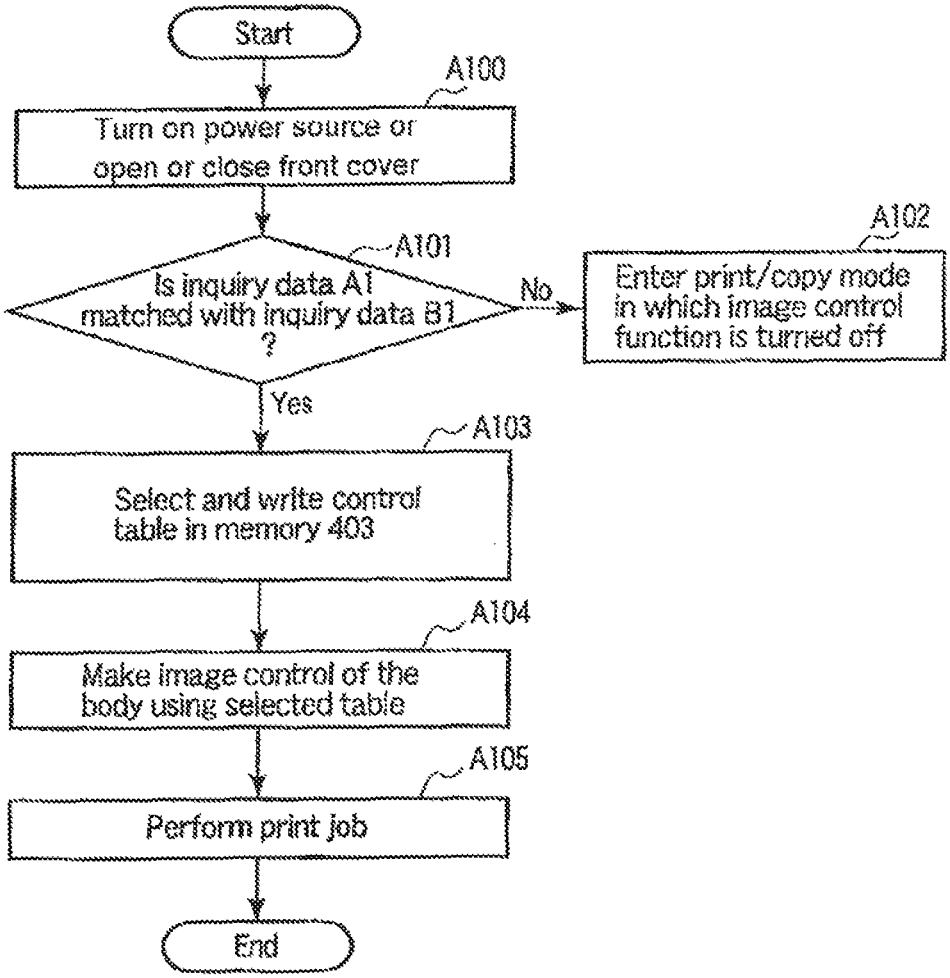
FIG. 4 is a flowchart illustrating an information writing process at the time of setting an image formation parameter in the image forming apparatus according to the first embodiment.

FIG. 4 is a flowchart illustrating a process of writing information to the memory 111 and the memory 403 at the time of setting the image formation parameters according to the first embodiment.

First, when the CPU 110 recognizes that the image forming apparatus 101 is turned on or a front cover 1*a* is opened or closed (Act 100), the CPU performs the following processes. The CPU 110 compares inquiry data A1 stored in a predetermined area of the memory 111 of the image forming apparatus 101 with inquiry data B1 stored in a predetermined area of the memory 403 of the toner cartridge (Act 101). The image forming apparatus stores the same code A1 as the inquiry code B1 previously acquired from the toner cartridge 40*a*.

When the inquiry data A1 is not matched with the inquiry data B1 (No in Act 101), the CPU 110 does not change the image formation parameter described in this embodiment, but performs a normal printing operation (Act 102). That is, only when the image forming apparatus 101 can recognize the inserted toner cartridge 40*a*, the CPU performs the process condition control of changing the image formation parameter.

When the inquiry data A1 is matched with the inquiry data B1 (Yes in Act 101), the CPU 110 selects and reads one of the image-formation control tables stored in the memory 403. Then, the CPU 110 writes the selected control table to the memory 111 (Act 103).

Here, the CPU 110 selects the control table as follows. It is assumed herein that plural control tables are prepared depending on the resistance value of the toner.

As shown in FIG. 5, three patterns of the toner resistance values less than 8.0, 8.0 or more and less than 14.0, and 14.0 or more are prepared in the control tables. The CPU 110 selects one control table from the tables. The selection method is not limited. The table read by a service man's selection may be changed at that time, or a table may be determined by default and may be then changed by the setting.

As shown in FIG. 6, in the control tables, bias voltages C1, C2, C3, . . . , or D1, D2, D3, . . . , or E1, E2, E3, . . . of the charger are set depending on the temperature range or the humidity range, which are controlled depending on the environment (temperature or humidity) or the life time. In the control tables, the bias voltages F1, F2, F3, . . . of the charger may be set depending on the number of printed sheets. The environment or the life may be combined to prepare a set of tables for any toner resistance value. Three tables shown in FIG. 5 are set correspondingly to the toner resistance values such that the bias voltages C1, C2, and C3 of the charger in each table are changed depending on the humidity ranges.

Then, the CPU 110 sets the image formation parameters from the selected control table by the use of the values calculated from the temperature and humidity sensor 112 or a printed sheet counter 116 disposed at predetermined positions in the image forming apparatus 101. That is, the CPU 110 extracts the operation setting values defined using the environment temperature or the relative humidity or the number of printed sheets as variables from the control table and sets the extracted setting values as the image formation parameters. The CPU 110 does the optimal process condition control (image control) using the set image formation parameters (Act 104). Then, the CPU 110 performs a printing operation of 1 job under the optimal process condition control (Act 105).

In the above-mentioned embodiment, the CPU 110 reads control data from the selected table on the basis of the value detected by the temperature and humidity sensor 112 disposed in the image forming apparatus 101, writes the read control data to the memory, and changes the image formation parameters on the basis of the control data, thereby performing the optimal process condition control. In addition to the values of temperature and humidity, the image formation parameters may be changed to perform the optimal process condition control with reference to the control table based on the counted number of printed sheets in the image forming apparatus 101 or the counted use time of expendable supplies such as the developer in the photoconductive drum 11*a* and the developing device 13*a*. The controlled voltage value of the fixing device 19 may be optimized to perform the process condition control on the basis of the counted value of the fixing device 19.

FIG. 7 is a diagram illustrating the comparison result of the process condition control when plural control tables are stored in the memory 403 of the toner cartridge 40*a* with the process condition control when a predetermined control table is stored in the memory 111 of the image forming apparatus 101.

By using the plural control tables recorded in the memory 403 of the toner cartridge 40*a*, it is possible to more properly perform a printing operation in view of the image concentration and the foggy rate.

As described above, since the toner cartridge 40*a* records the control tables suitable for the toner cartridge 40*a* in the memory 403, the image forming apparatus 101 can make the optimal process condition control corresponding to the toner cartridge 40*a* with reference to the control tables in the memory 403. Accordingly, the toner cartridge 40*a* can be used for a long time.

Although the toner cartridge 40*a* is exemplified in the above-mentioned embodiment, the above-mentioned embodiment can be applied to expendable supplies such as the photoconductive drum 11*a*, the fixing device 19, the cleaner 16*a*, and the developing device 13*a* containing the developer. The embodiment can be applied to a printer as well as the image forming apparatus 101.

Figure 8:
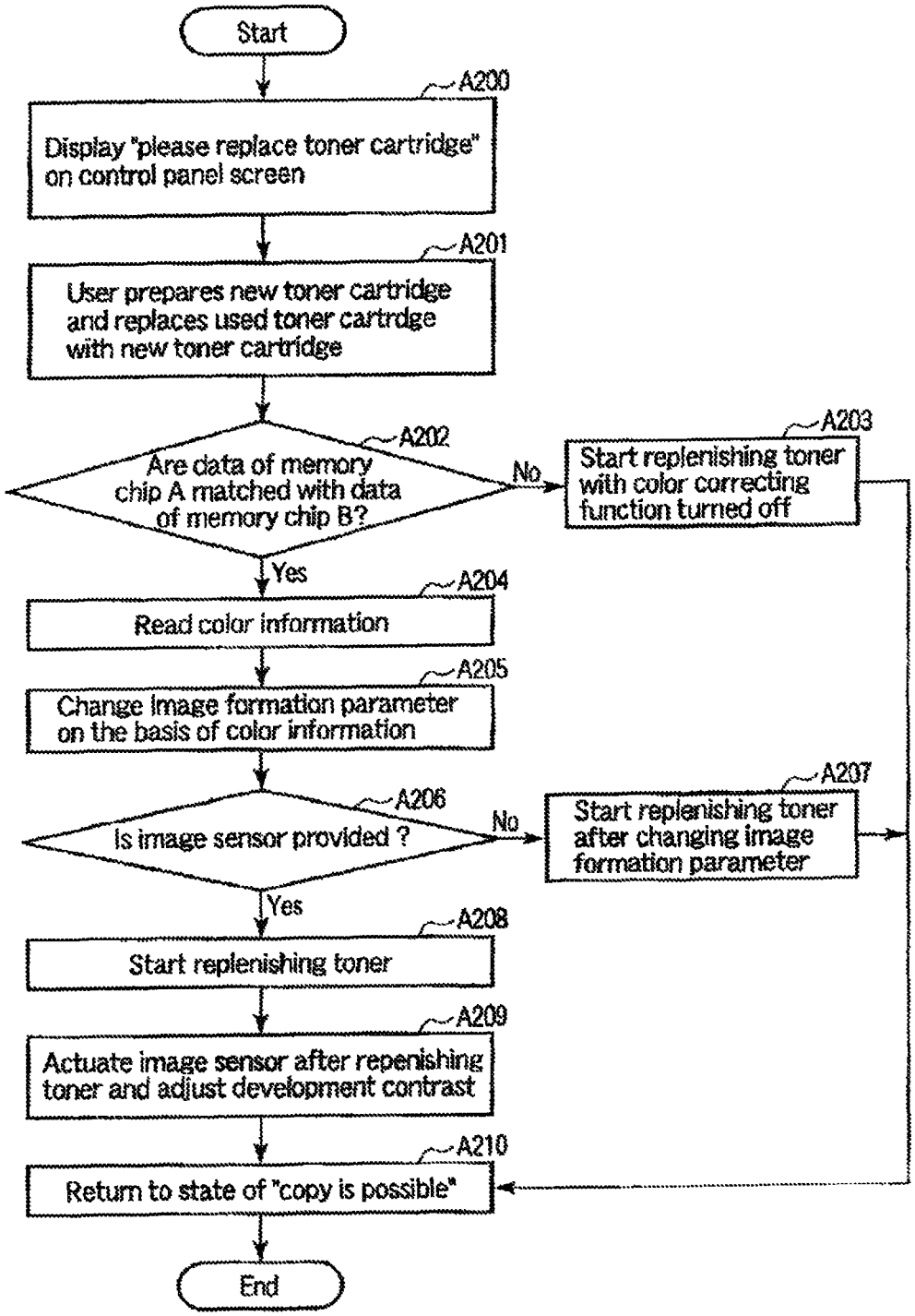
FIG. 8 is a flowchart illustrating a process of setting the image formation parameter using color information in an image forming apparatus according to a second embodiment.

The change of image formation parameters according to a second embodiment based on the color information recorded in the memory 403 when the toner cartridge 40*a* is mounted on the image forming apparatus 101 will be described now with reference to the flowchart shown in FIG. 8.

Inquiry data are stored in the memory 403 of the toner cartridge 40*a* similarly to the first embodiment. Color information is also stored in the memory. The color information is information obtained by measuring color coordinates (L*, a*, b*) of the toner filled in the toner cartridge 40*a* by the use of the X-Lite.

When the CPU 110 detects that the toner filled in the toner cartridge 40*a* is exhausted, the CPU displays "please replace the toner cartridge 40*a*" on the display unit 9 (Act 200). A user demounts the used toner cartridge 40*a* from the image forming apparatus 101 and mounts a new toner cartridge 40*a* on the image forming apparatus 101 (Act 201). When the new toner cartridge 40*a* is mounted on the image forming apparatus 101, the CPU 110 inquires the information in the memory 111 of the image forming apparatus 101 and the information in the memory 403 of the toner cartridge 40*a* (ACT 202).

When the memory 403 is not disposed in the toner cartridge 40*a* or when the inquiry data cannot be read (No in Act 202), the CPU 110 does not change the image formation parameters based on the color information, but supplies the toner to the developing device 13*a* and displays the mark of "under toner supply" on the display unit 9 (Act 203). Only when the inquiry is confirmed, the change of the image formation parameters based on the color information is valid.

Figure 9:
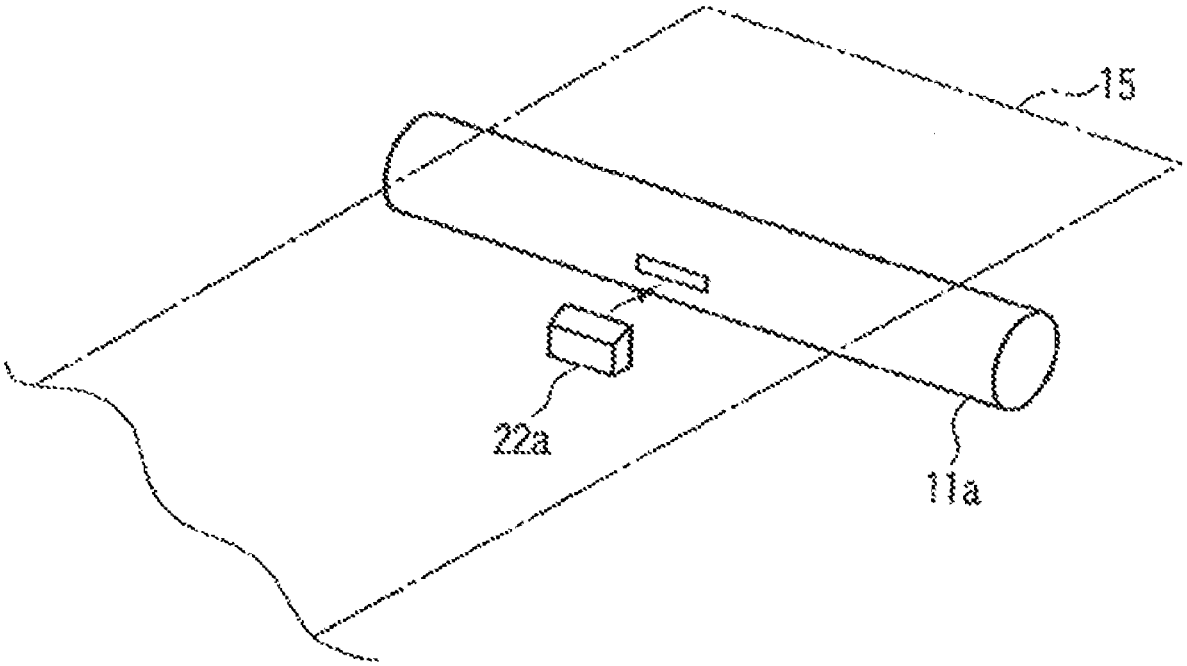
FIG. 9 is a diagram illustrating an image sensor disposed in the image forming apparatus according to the second embodiment.

When the inquiry is confirmed, the CPU 110 reads the color information stored in the memory 403 (Act 204) and changed the image formation parameters (Act 205). The image formation parameters before change are stored in the memory 111 of the image forming apparatus 101. When the CPU 110 recognizes that an image sensor 22*a* is disposed in the image forming apparatus 101 after changing the image formation parameters based on the color information as shown in FIG. 9 (Yes in Act 207), the developing device 13*a* supplies the toner (Act 209). The image sensor 22*a* is located in the lower surface side of the transfer belt 15 and serves to sense the toner concentration of the electrostatic latent image on the photoconductive drum 11*a*. The image sensor is also disposed in the developing devices 13*b*, 13*c*, and 13*d*.

When the developing device 13*a* finishes the supply of toner, the CPU 110 actuates the image sensor 22*a* to acquire the toner concentration. Then, the CPU 110 adjusts the development contrast in the developing device 13*a* on the basis of the acquired toner concentration (Act 209).

When the adjustment of the development contrast is finished, the CPU 110 displays the mark of "printable" on the display unit 9 (Act 210).

Figure 10:
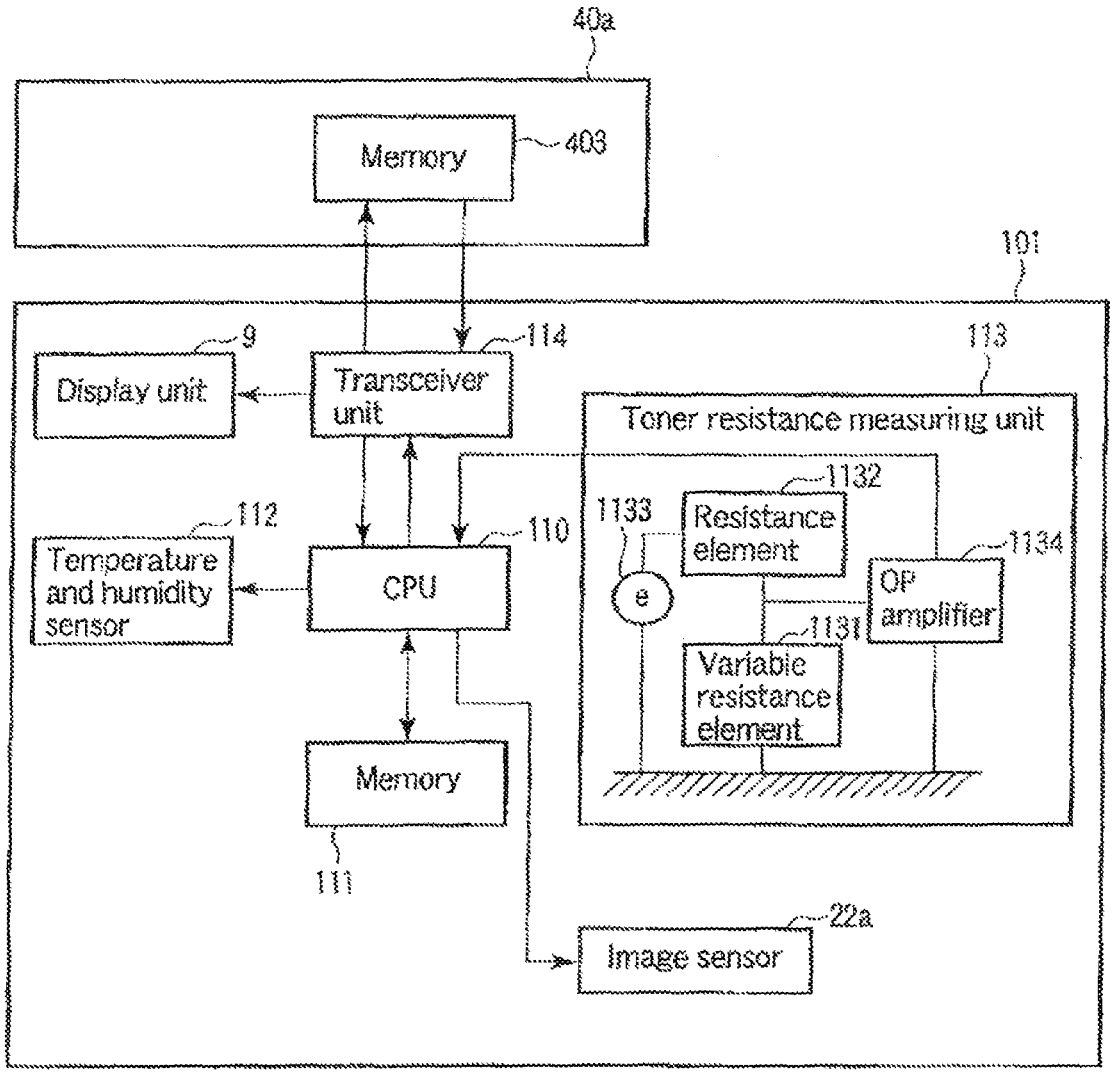
FIG. 10 is a block diagram illustrating operations of an image forming apparatus and a toner cartridge according to a third embodiment.

As shown in FIG. 10, when the image sensor 22*a* is not disposed in the image forming apparatus 101 (No in Act 207), the CPU 110 changes the image formation parameters on the basis of the color information and then the developing device 13 starts the supply of toner (Act 207).

With the above-mentioned configuration, even when the toner cartridge 40*a* is replaced, the image forming apparatus 101 reads the color information of the toner filled in the toner cartridge 40*a* and changes the image formation parameters on the basis of the color information, thereby accomplishes the stable color reproducibility. Of course, similarly to the first embodiment, the color information may be previously stored in plural control tables depending on the physical properties of the toner and may be selected from the control tables.

A third embodiment will be described with reference to the block diagram illustrating the operations of the toner cartridge 40*a* and the image forming apparatus 101 shown in FIG. 10.

The memory 403 of the toner cartridge 40*a* stores material characteristic information and variable resistance element characteristic information.

The material characteristic information is information indicating variations in toner characteristics (such as the amount of charged electricity, the fluidity of the toner, and the toner resistance value) depending on the environment (the absolute humidity in the image forming apparatus 101). The variable resistance element characteristic information is information for correlating the toner resistance values with the absolute humidity of 20% to 85% or characteristic curve information for converting the toner resistance value into the absolute humidity.

First, when the toner cartridge 40*a* is mounted on the image forming apparatus 101, the CPU 110 acquires inquiry data from the memory 403 of the toner cartridge 40*a*. The CPU 110 compares the acquired inquiry data with the inquiry data stored in the apparatus body and determines whether a desired toner cartridge 40*a* is mounted thereon.

When the CPU 110 does not determine that the desired toner cartridge 40*a* is mounted thereon, the material characteristic of the toner filled in the toner cartridge 40*a* is not clear and thus the setting of the image formation parameters described below is not performed. The CPU 110 controls the display unit 9 to display the mark of "not mounted with the toner cartridge 40*a*."

The CPU 110 determines that the desired toner cartridge 40*a* is mounted thereon on the basis of the inquiry data, the CPU 110 acquires the material characteristic information and the variable resistance element characteristic information from the memory 403 of the toner cartridge 40*a*. Here, a toner resistance measuring unit 113 includes a variable resistance element 1131 of which the resistance value varies depending on the environment conditions such as temperature and humidity, a resistance element 1132 which is connected in series to the variable resistance element 1131 and of which the resistance value does not vary depending on the environments, a power source 1133 applying a voltage of 5 V or 12 V across the resistance element 1132 and the variable resistance element 1131, and an OP amplifier 1134 reading the voltage value across the variable resistance element 1131. The CPU 110 can calculate the toner resistance value, which is the resistance value of the variable resistance element 1131, varying from the voltage value across the variable resistance element 1131, which is read by the OP amplifier 1134. The toner resistance measuring unit 113 measures the voltage value of the variable resistance element read by the OP amplifier 1134 to measure the toner resistance value which is the value of the variable resistance element. The CPU 110 acquires the environment conditions by comparing the toner resistance value measured by the toner resistance measuring unit 113 with the variable resistance element characteristic information acquired from the memory 403 of the toner cartridge 40*a*.

Here, the variable resistance element may be disposed on the toner resistance measuring unit 113 of the image forming apparatus 101 or may be disposed in the toner cartridge 40*a*.

The CPU 110 acquires the image formation parameters stored in the memory 111. The CPU 110 changes the image formation parameters defined depending on the environment conditions and the material characteristics to the optimal values corresponding to the environment conditions and the material characteristic information acquired from the memory 403 of the toner cartridge 40*a*. The image formation parameters are parameter data in which the control voltages for the developing device 13*a*, the cleaner 16*a*, the charger 17*a*, and the fixing device 19 in the printing operation and the physical property values of the amount of charged electricity, the developing bias, the toner concentration (or the intensity of laser beams), the particle diameter distribution, and the heat characteristic on the photoconductive drum 11*a* are set for each material characteristic of the toner varying depending on the environment conditions. The CPU 110 sets the optimal image formation parameters depending on the material characteristics and the environment conditions for the units and performs the printing operation.

With the above-mentioned configuration, the image forming apparatus 101 according to this embodiment can set the image formation parameters for printing operation corresponding to the toner-specific characteristics of the toner filled in the toner cartridge 40*a* without causing the increase in size of the apparatus and the setting delay. That is, the toner filled in the toner cartridges 40*a* having the same product quality can be different in quality. Accordingly, even when a toner cartridge 40*a* filled with the cheap toner having low quality is mounted on the image forming apparatus 101, the image forming apparatus 101 can perform the optimal printing operation depending on the toner-specific material characteristics and the environment conditions.

What is claimed is:

1. A toner cartridge for use with an image forming apparatus having an acquiring unit configured to acquire identification data from the toner cartridge when the toner cartridge is mounted on the image forming apparatus; a reading unit configured to read parameter information including image formation process parameters, from the toner cartridge when the acquired identification data matches identifying data previously stored in the image forming apparatus, and not read the parameter information from the toner cartridge when the acquired identification data does not match the identifying data, the toner cartridge comprising:

a memory storing the identification data of the toner cartridge and the parameter information including the image formation process parameters dependent on toner characteristic or ambient conditions, the memory being configured to communicate with the acquiring unit or the reading unit by wire.

2. The toner cartridge of claim 1, wherein the memory stores a table in which at least a value of one of the image formation process parameters is associated with a temperature value.

3. The toner cartridge of claim 1, wherein the memory stores a table in which at least a value of one of the image formation process parameters is associated with a humidify value.

4. The toner cartridge of claim 1, wherein the memory stores a table in which at least a value of one of the image formation process parameters is associated with a life time.

5. The toner cartridge of claim 1, wherein the memory stores a table in which at least a value of one of the image formation process parameters is associated with a number of printed sheets.

6. The toner cartridge of claim 1, wherein the toner characteristic is toner resistance.

7. The toner cartridge of claim 1, wherein the toner characteristic is a particle diameter of toner.

8. The toner cartridge of claim 1, wherein the toner characteristic is a lot number for manufacturing toner.

9. The toner cartridge of claim 1, wherein the parameter information is based on color information.

10. A toner cartridge for use with an image forming apparatus having an acquiring unit configured to acquire identification data from the toner cartridge; and a reading unit configured to read parameter information including image formation process parameters from the toner cartridge, the toner cartridge comprising:

a memory storing the identification data and the parameter information including the image formation process parameters, and a table in which at least a value of one of the image formation process parameters is associated with a temperature value, the memory being configured to communicate with the acquiring unit or the reading unit by wire.

11. A toner cartridge for use with an image forming apparatus having an acquiring unit configured to acquire identification data from the toner cartridge; and a reading unit configured to read parameter information including image formation process parameters dependent on toner characteristic or ambient conditions, from the toner cartridge, the toner cartridge comprising:

a memory storing the identification data and the parameter information including the image formation process parameters, and a table in which at least a value of one of the image formation process parameters is associated with a humidity value, the memory being configured to communicate with the acquiring unit or the reading unit by wire.

12. An image forming apparatus comprising:

an acquiring unit which acquires identification data from a toner cartridge, when the toner cartridge is mounted on the image forming apparatus, the toner cartridge comprising a memory storing the identification data of the toner cartridge and parameter information including image formation process parameters dependent on toner characteristic or ambient conditions; and a reading unit which reads the parameter information including the image formation process parameters from the toner cartridge when the acquired identification data matches identifying data previously stored in the image forming apparatus, and not read the parameter information from the toner cartridge when the acquired identification data does not match the identifying data, the memory being configured to communicate with the acquiring unit or the reading unit by wire.

* * * * *